US007533870B2

(12) United States Patent
Camrass et al.

(10) Patent No.: US 7,533,870 B2
(45) Date of Patent: May 19, 2009

(54) PULLEY

(75) Inventors: Stephen Camrass, Stittsville (CA); John Slavish, Ottawa (CA)

(73) Assignee: Allan-Vanguard Technologies Inc., Ottawa, Ontario (CA)

( * ) Notice: Subject to any disclaimer, the term of this patent is extended or adjusted under 35 U.S.C. 154(b) by 144 days.

(21) Appl. No.: 11/812,329

(22) Filed: Jun. 18, 2007

(65) Prior Publication Data

US 2008/0111116 A1 May 15, 2008

Related U.S. Application Data

(60) Provisional application No. 60/805,037, filed on Jun. 16, 2006.

(51) Int. Cl.
*B66D 3/04* (2006.01)

(52) U.S. Cl. ..... 254/405; 254/402

(58) Field of Classification Search ..... 254/402, 254/403, 405, 406
See application file for complete search history.

(56) References Cited

U.S. PATENT DOCUMENTS

| | | | | |
|---|---|---|---|---|
| 610,172 | A | 9/1898 | Dotson | |
| 746,718 | A | 12/1903 | Loth | |
| 796,366 | A | 8/1905 | Smith | |
| 847,955 | A | 3/1907 | Lindsay | |
| 1,135,740 | A | 4/1915 | Thorp | |
| 1,141,745 | A | 6/1915 | Worrell | |
| 1,428,118 | A | 9/1922 | Robeson | |
| 1,894,286 | A | 1/1933 | Van Der Schans et al. | |
| 1,908,784 | A | 5/1933 | Peterson | |
| 2,235,302 | A | 3/1941 | Stillwagon | |
| 2,474,433 | A | 6/1949 | McKissick | |
| 2,527,350 | A | 10/1950 | Brown | |
| 3,094,313 | A | 6/1963 | Filipozzi et al. | |
| 3,275,301 | A | 9/1966 | Read | |
| 3,372,908 | A | 3/1968 | McCarthy | |
| 3,618,900 | A * | 11/1971 | Sowards et al. | 254/405 |
| 3,721,201 | A | 3/1973 | Boller | |
| 3,787,032 | A | 1/1974 | Bagby | |
| 3,800,715 | A | 4/1974 | Boller | |
| 4,325,537 | A * | 4/1982 | Winter et al. | 254/405 |
| 4,327,897 | A * | 5/1982 | Smith | 254/395 |
| 5,201,496 | A | 4/1993 | Bradette et al. | |
| 5,249,543 | A | 10/1993 | Rutgerson et al. | |
| 6,263,999 | B1 * | 7/2001 | Atkinson et al. | 182/5 |

FOREIGN PATENT DOCUMENTS

| | | |
|---|---|---|
| CH | 247589 | 12/1947 |
| CH | 254350 | 12/1948 |
| CH | 281845 | 7/1952 |
| DE | 850943 | 9/1952 |
| DE | 173022 | 11/1952 |
| FR | 603470 | 4/1926 |

* cited by examiner

*Primary Examiner*—Emmanuel M Marcelo

(57) ABSTRACT

A pulley comprises a pulley frame having two sides. A pulley wheel is located between the two sides. The pulley wheel is rotatably supported by the pulley frame. At least one of the sides is mounted for movement away from the pulley wheel to provide a gap between the moveable side and the wheel for releasing a line from the pulley. A latch is provided for releasably retaining the at least one side in the closed position to confine a line between the two sides. The latch is adapted to release the movable side when a predetermined force is applied to the latch. A retainer responsive to the release of the latch holds the moveable side in the open position when released.

23 Claims, 6 Drawing Sheets

PULLEY

RELATED APPLICATION

This application claims the benefit of U.S. provisional patent application No. 60/805,037, entitled "PULLEY", filed on Jun. 16, 2006 which is incorporated herein by reference in its entirety.

FIELD OF THE INVENTION

This invention relates to a pulley and in particular a line releasing pulley which can be utilized for the remote conveyance of an article, such as a suspected explosive device, along a complex path.

BACKGROUND OF THE INVENTION

In the bomb disposal field it is frequently desirable to remove a device that is suspected of being an explosive device from a building or other location in which it has been found. One approach to removing such an article involves the use of pulleys and lines or ropes to move the device remotely. The pulleys and lines can be set up to define a complex path through which the article can be pulled. In order to allow the article to move along the complex path, it is necessary that the pulleys be able to release the line travelling through each pulley, at the desired time, without being visible or separately manipulated by the user.

U.S. Pat. No. 5,201,496 discloses a line release pulley. The pulley has a pivoting cheek plate that allows release of a line. However, there is no means of ensuring that the pivoting cheek plate opens only at the desired time and that the line remains released.

SUMMARY OF THE INVENTION

According to one aspect of the present invention, there is provided a pulley comprising: a pulley frame comprising two sides; a pulley wheel between the two sides, the pulley wheel being rotatably supported by the pulley frame; a pivoting means pivotally connecting at least one of the two sides of the pulley frame for pivoting the at least one side between a closed position for confining a line between the two sides and an open position for releasing the line from the pulley; a latch for releasably retaining the at least one side in the closed position, the latch being adapted to release the at least one side when a predetermined force is applied to the latch; and a biasing means associated with the at least one side which biases the at least one side to the open position when the latch is released.

In some embodiments, the biasing means is integral to the pivoting means.

In some embodiments, the pivoting means comprises a hinge including a hinge pin and the biasing means comprises an axial torsion spring mounted on the hinge pin.

In some embodiments, the biasing means comprises at least one elastic cord connected between the at least one side and the pulley frame wherein the at least one elastic cord is stretched in the closed position and contracted in the open position.

In some embodiments, at least two holes are defined through the at least one side and the elastic cord is interconnected to the at least one side through the at least two holes.

In some embodiments, the elastic cord is held within the frame by being clamped between elements of the frame.

In some embodiments, the latch is self-opening upon application of the predetermined force by the line or a breaker on the line.

In some embodiments, the pulley further comprises a lock movable between a locked position and an unlocked position wherein in the locked position the at least one side is prevented from moving to the open position when the predetermined force is applied and in the unlocked position the at least one side is movable to the open position.

According to another embodiment of the invention, there is provided a pulley comprising: a pulley frame comprising two sides; a pulley wheel between the two sides, the pulley wheel being rotatably supported by the pulley frame; a pivoting means pivotally connecting at least one of the two sides to the pulley frame for pivoting the at least one side between an open position and a closed position; a latch for releasably retaining the at least one side in the closed position to confine a line between the two sides, the latch being adapted to release the at least one side when a predetermined force is applied; and a lock movable between a locked position and an unlocked position wherein in the locked position the at least one side is prevented from moving to the open position when the predetermined force is applied and in the unlocked position the at least one side is movable to the open position.

In some embodiments, the lock is independent of the latch.

In some embodiments, the lock is accessible from both outer sides of the pulley.

In some embodiments, the lock comprises a movable part and a protruding element, the movable part defining a lip adapted to engage the protruding element in the locked position, the movable part and the protruding element forming part of respective ones of the frame and the at least one side.

In some embodiments, the movable part is movable in a direction perpendicular to a rotational axis of the pulley wheel and a pivoting axis of the at least one side.

In some embodiments, the movable part comprises a threaded knob which is rotatable to move axially between the locked position and the unlocked position.

In some embodiments, the threaded knob projects through openings defined in the two sides.

In some embodiments, the shape of the openings define limits of travel of the threaded knob.

In some embodiments, the protruding element comprises a portion of one of the sides which protrudes into the opening.

In some embodiments, the lip is defined by a groove in the knob.

In some embodiments, the lock further comprises an override movable between an activated position and an unactivated position wherein in the activated position the lock is prevented from moving and in the unactivated position the lock is movable.

A further embodiment of the invention provides a pulley comprising: a pulley frame comprising two sides; a pulley wheel between the two sides, the pulley wheel being rotatably supported by the pulley frame; at least one of the sides being mounted for movement away from the pulley wheel to provide a gap between the moveable side and the wheel for releasing a line from the pulley; a latch for releasably retaining the at least one side in the closed position to confine a line between the two sides, the latch being adapted to release the moveable side when a predetermined force is applied to the latch; and a retainer responsive to the release of the latch to hold the moveable side in the open position.

In some embodiments, the pulley further comprises a lock movable between a locked position and an unlocked position wherein in the locked position the movable side is prevented from moving to the open position when the predetermined force is applied and in the unlocked position the moveable side is movable to the open position.

In some embodiments, the retainer moves when the latch is released.

In some embodiments, the retainer comprises at least one pair of magnets of opposite polarity.

BRIEF DESCRIPTION OF THE DRAWINGS

Embodiments of the invention will now be described with reference to the attached drawings in which.

DETAILED DESCRIPTION OF THE EMBODIMENTS

Figure 1:
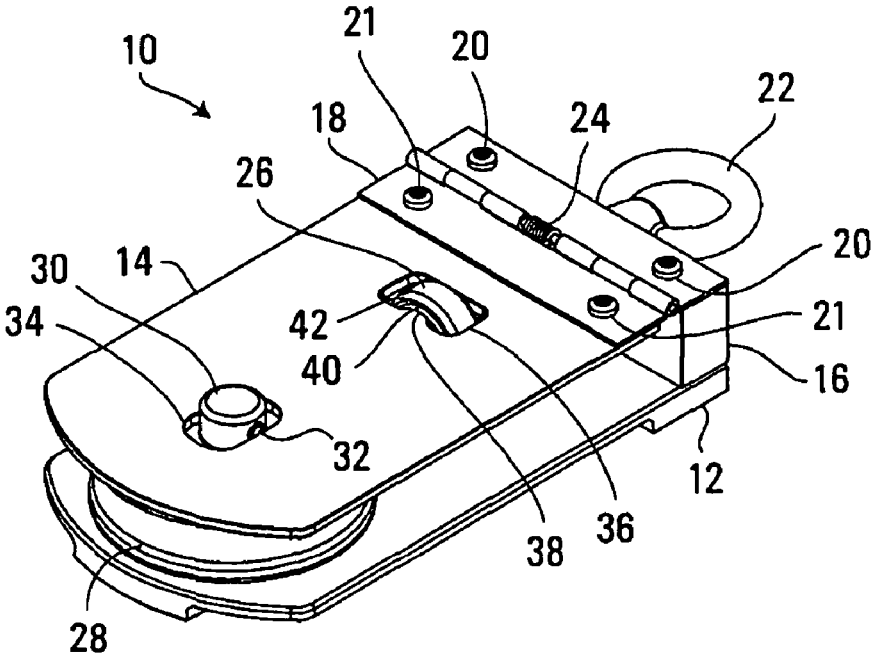
FIG. 1 is a perspective view of a pulley in a closed position according to a first embodiment of the invention.
Figure 2:
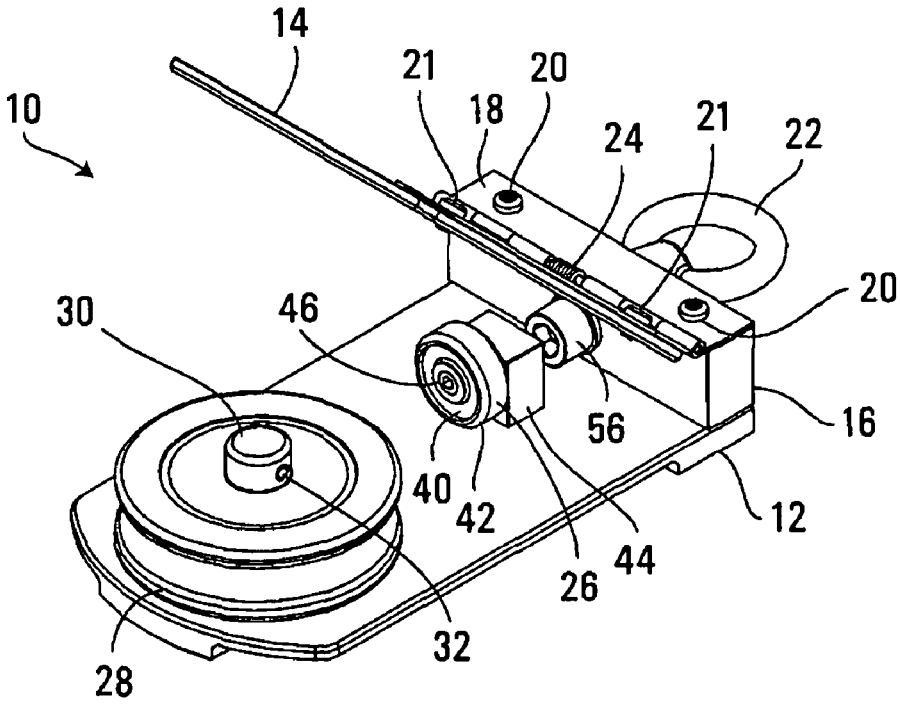
FIG. 2 is a perspective view of the pulley of FIG. 1 in an open position.

The figures depict pulleys according to embodiments of the invention. Each pulley comprises a pulley frame which has two sides. A pulley wheel is rotatably supported by the pulley frame between the two sides. At least one of the two sides is moveably connected to the frame, for example, by a hinge. The moveably connected side is moveable between an open position and a closed position. A latch is provided which releasably retains the moveably connected side in a closed position. A retaining means is provided which retains the moveably connected side in the open position when the latch is released.

In addition to the retaining means, or alternatively to the retaining means, each pulley may include a lock. The lock is movable between a locked position and an unlocked position. In a locked position, the moveably connected side is prevented from moving to the open position and in the unlocked position the moveably connected side is moveable to the open position.

Turning to the figures in detail, FIGS. 1 through 4 depicts a pulley according to a first embodiment of the invention. A pulley 10 is provided, which has a pulley frame which is comprised of a fixed side plate 12, a block 16 and a pivoting side plate 14. The block 16 interconnects and spaces the fixed side plate 12 and the pivoting side plate 14. An end of the fixed side plate 12 is fastened to the block 16 by screws (not shown). An end of the pivoting side plate 14 is fastened to a hinge 18 by screws 21. The hinge 18 is in turn fastened to the block 16 by screws 20. Although, screws 20 and 21 are shown, it will be understood that other fastening means may also be employed. Similarly, although the hinge 18 is depicted; other pivoting means may also be employed. Means of interconnecting and spacing the side plates 12 and 14, other than block 16, may also be used. For example, the hinged side plate 14 and the hinge 18 may be integrally formed. Also, the fixed side plate 14 and the block 16, or other spacing means, may be integrally formed.

An optional eye nut 22 is mounted to the block 16 by a screw 56 which extends through a hole in the block 16 and is screwed into threads internal to the eye nut 22. A washer 64 spaces the eye nut 22 from the block 16. The eye nut 22 may be used to fix the pulley 10 in a desired location. The eye nut 22 may be pivotable to allow added manoeuvrability of the pulley 10. Other mounting means for mounting the pulley 10, which do not utilize an eye nut 22, are also contemplated for other embodiments of the invention.

A spring 24, such as an axial torsion spring is associated with the hinge 18. In the case of an axial torsion spring, a hinge pin extends through the axis of the spring 24 thereby holding the spring in position. The spring 24 provides a bias i.e., exerts a force, in a direction to open the pivoting side plate 14 to the open position depicted in FIGS. 2 and 4. In the open position, the pivoting side plate 14 is moved sufficiently away from the opposed frame assembly which includes the fixed side plate 12, to provide a gap through which a line may pass. The spring 24 then holds the pivoting side plate 14 in the open position. This prevents the pivoting side plate 14 from unintentionally closing to trap the line after it has been released.

The degree to which the pivoting side plate 14 is shown as open in the figures is not essential. The pivoting side plate 14 need open only sufficiently to allow a line held within the pulley to be released and prevent the line from being unintentionally trapped. The holding of the pivoting side plate 14 in the open position also changes the centre of gravity of the pulley. If the pulley 10 is suspended, the change is the centre of gravity will tend to tilt the pulley 10 so the fixed side plate 12 is angled outward, away from the vertical. This also aids in releasing the line.

Figure 5:
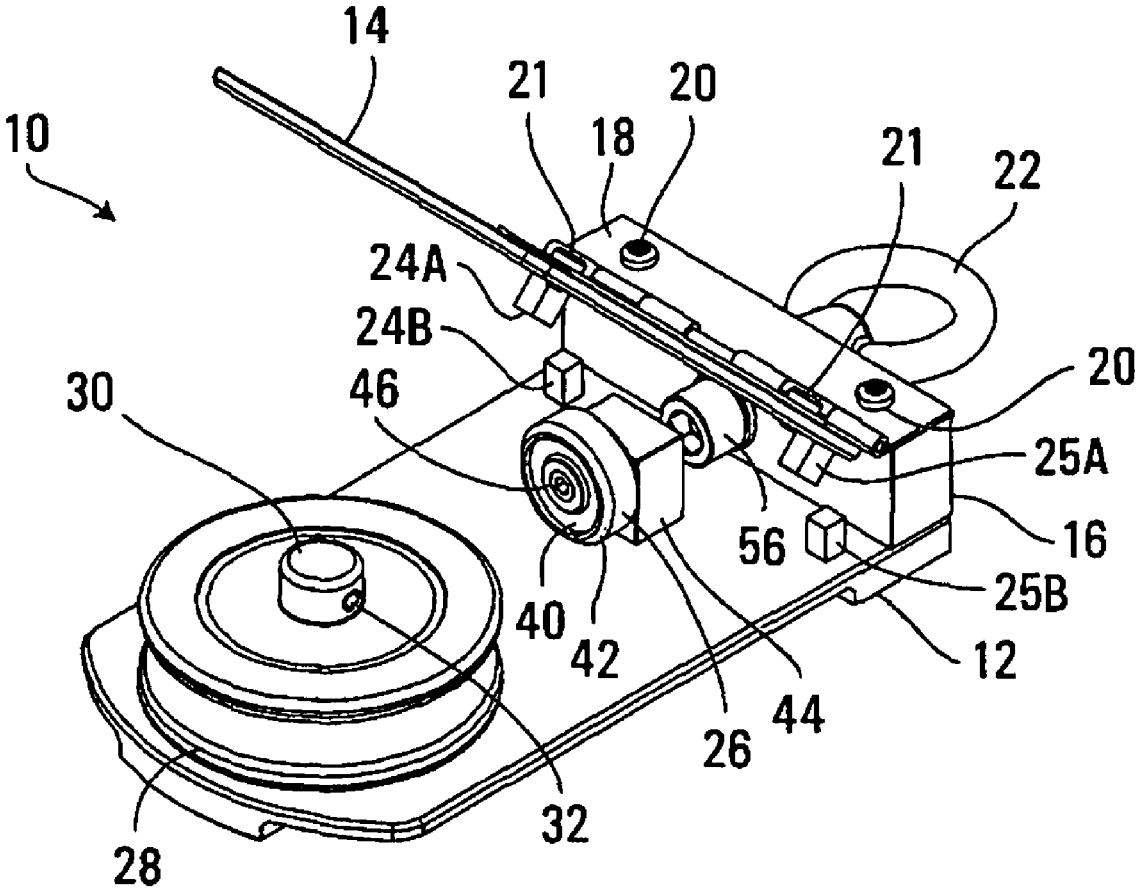
FIG. 5 is a perspective view of a pulley in an open position according to a second embodiment of the invention.

Other biasing means may be used which function to open the pivoting side plate to the open position and hold it open. Non-biasing means may also be used to retain the pulley in the open position. For example, aligned magnets of opposite polarity may be used. FIG. 5 is identical to FIG. 2 except that spring 24 has been replaced with an example of pairs of magnets 24A and 24B and 25A and 25B. Magnets 24A and 25A are affixed to the inside surface of the pivoting side plate 14 by, for example, an adhesive. Magnets 24B and 25B are affixed to fixed side plate 12 in a similar manner. When in the closed position, the pairs of magnets 24A and 24B and 25A and 25B are aligned. Magnets 24A and 24B are of opposite polarity such that they repel each other. The same is true for magnets 25A and 25B. When the latch is released, the repelling magnets hold the pulley in an open position. Other shapes of opposite polarity magnets, locations and configuration may be used. Alternatively, a mechanical means such as an arm which rotates or drops into position, once the latch is released, may also be used. The arm could act as a brace between the sides to maintain the open position.

The pulley 10 includes a pulley wheel 28 and a pin 30. The fixed side plate 12 has a centrally located hole defined therethrough towards an end opposite to the block 16 for receiving a shaft of the pin 30. The pin 30 has a head (not shown) which rests against an outside surface of the fixed side plate 12. The pulley wheel 28 is rotatably mounted on the pin 30 to rest against an inner surface of the fixed side plate 12. The pin 30 therefore functions as the rotational shaft for the pulley wheel 28. Various means may be used to retain the pulley wheel 28 in position, such as defining a groove around the circumference of the pin 30 and placing a retaining washer over the pulley wheel 28 within the groove. Other means of mounting and rotatably retaining the pulley wheel 28 may be used.

The pulley wheel 28 may have a contoured outer circumference, such as the symmetrical concave groove around the circumference, as seen in the drawings, which aids in retaining a line travelling over the pulley in a central position.

The pin 30 includes detent 32. The detent 32 is a ball which is biased outward, for example, by a spring internal to the pin 30. The detent 32 functions as a latch which can be opened to release the pivoting side plate 14 to an open position. The operation of the latch is as follows. The pivoting side plate 14 has a latch opening 34 defined therein. When the pivoting side plate 14 is in a closed position (see FIGS. 1 and 3), the side plates 12 and 14 are parallel, a line (not shown) within the pulley 10 runs over the pulley wheel 28, and the pin 30 extends outwards through the latch opening 34. The detent 32 rests against an outer surface of the pivoting side plate 14 to hold the pivoting side plate 14 in a closed position. When sufficient force, of a predetermined amount, is applied parallel to a rotational axis of the pulley wheel 28, the detent 32 is pressed into the detent pin 30 by the pivoting side plate 14 and an edge of the latch opening 34. The pivoting side plate 14 is thus released. The pivoting side plate 14 may be bevelled around latch opening 34 to facilitate the depression of the detent 32. Once the pivoting side plate 14 is released by the detent 32, the spring 24 acts to rotate the pivoting side plate 14 to an open position shown in FIGS. 2 and 4. In the open position, the pivoting side plate 14 is opened at least to a point where there is a gap, between the pivoting side plate 14 and the nearest part of the pulley wheel 28 and pin 30 assembly, sufficiently wide to allow passage of a line.

The opening force to open the pivoting side plate 14 may be applied in various manners. For example, the line travelling through the pulley may have a breaker such as an enlarged cone which has an outer dimension larger than the spacing between the fixed side plate 12 and the pivoting side plate 14 when closed such that as the breaker moves between the plates the size of the breaker exerts an opening force on the pulley 10 to release the detent 32.

Although the embodiment of FIGS. 1 to 4 utilizes the detent 32 as a latch, other latching means may be used. Additionally, although the latch shown is "self-opening" in that it can be opened without any manual manipulation of the latch, other latching systems that require manual manipulation may alternatively be used.

The pulley 10 also incorporates a lock which is rotatably mounted to the pulley frame to selectively lock and unlocked and respectively disable and enable the opening of the pivoting side plate 14. In this embodiment the lock includes a lock knob 26 and a lock mount 44. The lock mount 44 is fastened to the fixed side plate 12, for example, by screws. An internal thread is defined through the lock mount 44. The lock knob 26 has a groove 40 formed around its circumference which forms a lip 42 around the outer circumference of the lock knob 26. A lock shaft comprises a threaded shaft 46 which connects the lock knob 26 to the lock mount 44. In other words, the threaded shaft 46 connects the lock knob 26 to the lock mount 44.

The pivoting side plate 14 has a lock knob opening 36 defined therethrough. In a closed position, shown in FIGS. 1 and 3, the lock knob 26 extends through the lock knob opening 36. The lock knob opening 36 has an protruding portion 38 which protrudes into the opening 36. The protruding portion 38 is sized to fit within the groove 40. In the closed position, the protruding portion 38 is aligned with the groove 40. The lock knob 26 is moved towards and away from the protruding portion 38 by rotation of the lock knob 26. In other words, rotation of the lock knob 26, in one direction, will screw the threaded shaft 46 into the lock mount 44 so that the lock knob 26 moves towards the lock mount 44 and thus away from the protruding portion 38. When the lock knob 26 is rotated in the opposite direction, the lock knob 26 moves towards the protruding portion 38.

Figure 3:
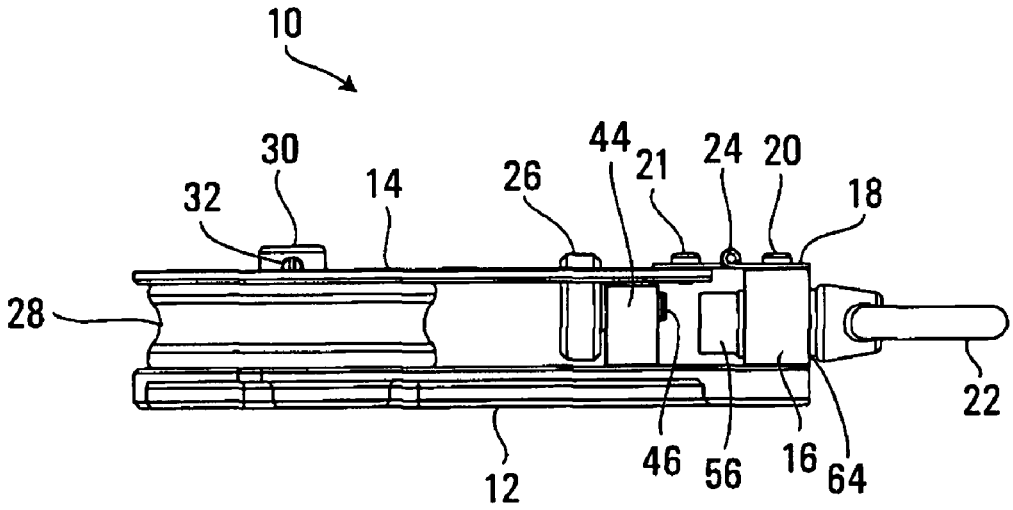
FIG. 3 is a side view of a pulley of FIG. 1 in a closed position.
Figure 4:
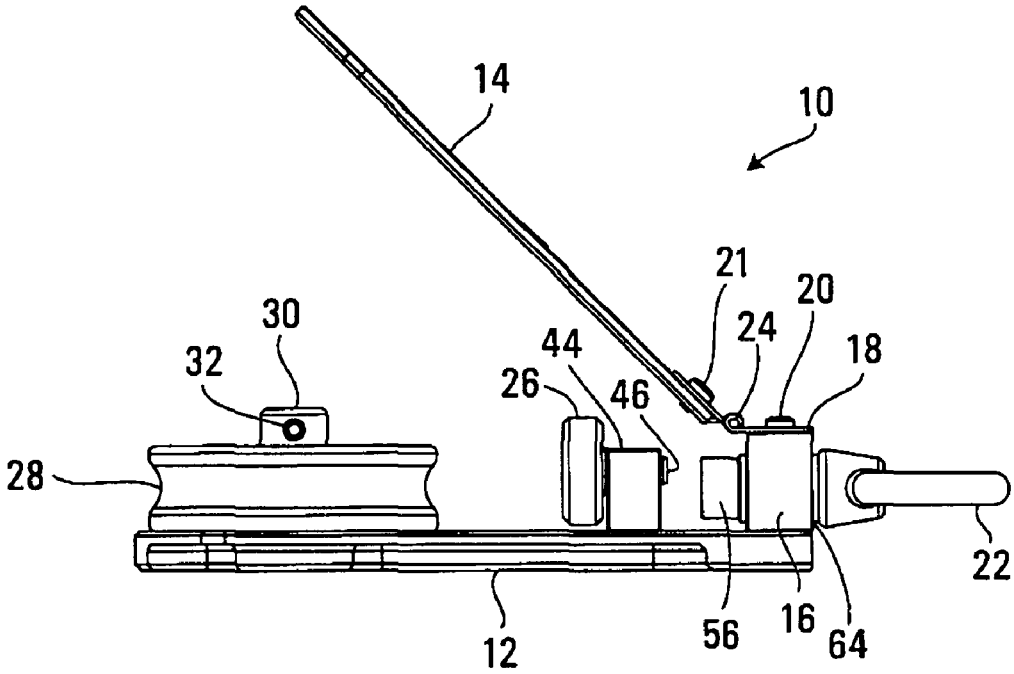
FIG. 4 is a side view of the pulley of FIG. 1 in an open position.

In operation, the lock knob 26 is rotated to move the lock knob 26 towards the lock mount 44 such that the lip of the lock knob 26 is clear of the protruding portion 38 when the pivoting side plate 14 is being closed. Once the pivoting side plate 14 is closed, the lock knob 26 can be rotated in the opposite direction to move the lock knob 26 towards the protruding portion 38 and the protruding portion 38 within the groove 40. Once the protruding portion 38 lies within the groove 40, the lip 42 overlaps the protruding portion 38 blocking upward movement of the protruding portion 38, and consequently the side plate 14. The pivoting side plate 14 is thereby locked in place. Thus, even if a force is applied to the pivoting side plate 14 which would normally be sufficient to release the detent 32 and open the pivoting side plate 14, the lip 42 overlapping of the protruding portion 38 will block the pivoting side plate 14 from opening and therefore lock the pivoting side plate 14 in a closed position, as shown in FIGS. 1 and 3.

Although a particular locking assembly is shown in FIGS. 1 to 4, any other suitable locking mechanisms may be used to override the opening of the pivoting side which would otherwise occur when a force is applied that is sufficient to release the latch. For example, a locking mechanism may be used which comprises one or more removable components which clamp over the exterior of the side plates 12 and 14.

Although, the embodiment of FIGS. 1 to 4, gives an example in which both the pulley 10 and the lock are attached to the fixed side plate 12, this is not essential. The pulley wheel 28 and the lock could alternatively be fixed to the pivoting side plate 14, fixed to opposite side plates or otherwise mounted in the pulley 10, for example, by separate members fastened to the block 16.

Although only one pivoting side plate is shown, both side plates could alternatively be pivotable.

Although the sides are depicted as side plates 12 and 14, it will be understood that these elements need not take the form of plates and may take the form of any suitable member.

The rotational axis of the pulley wheel 28, the direction of the lock knob 26 and the pivoting axis of the hinge 18 are all shown as mutually perpendicular. Other locking and pivoting arrangements may result in different relative movement.

FIGS. 6 to 9 show another embodiment of a pulley according to the invention. The same reference characters are used in FIGS. 6 though 9 to identify the same features already discussed in FIGS. 1 to 4. FIGS. 6 to 9 will only be described with references to differences from FIGS. 1 to 4 or features not visible in FIGS. 1 to 4.

FIGS. 6 to 9 depict a pulley 110 having a fixed side plate 112, a pivoting side plate 114, a block 116 and a hinge 118.

Figure 6:
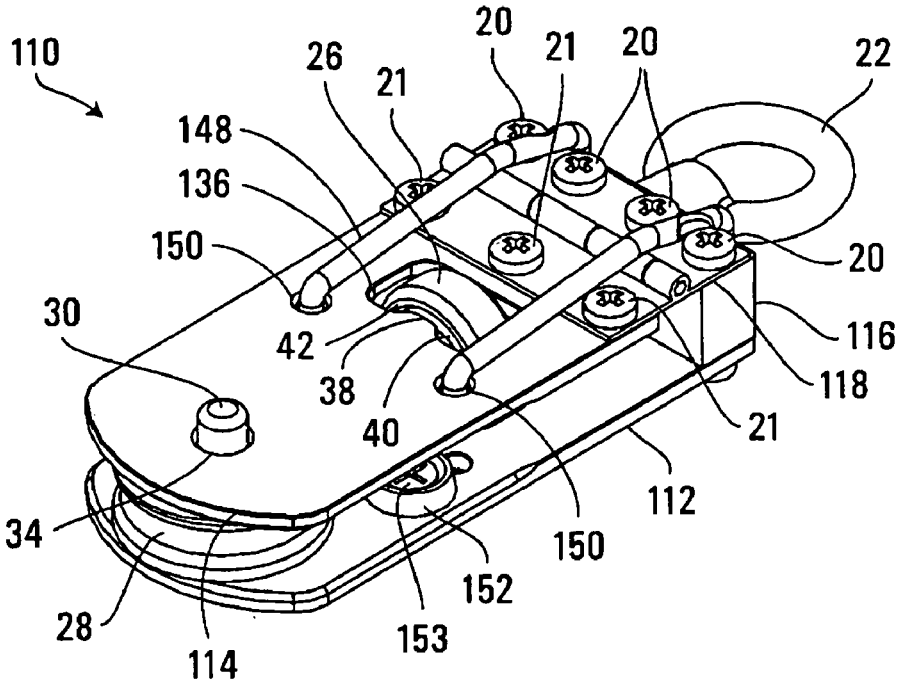
FIG. 6 is a perspective view of a pulley in a closed position according to a third embodiment of the invention.
Figure 7:
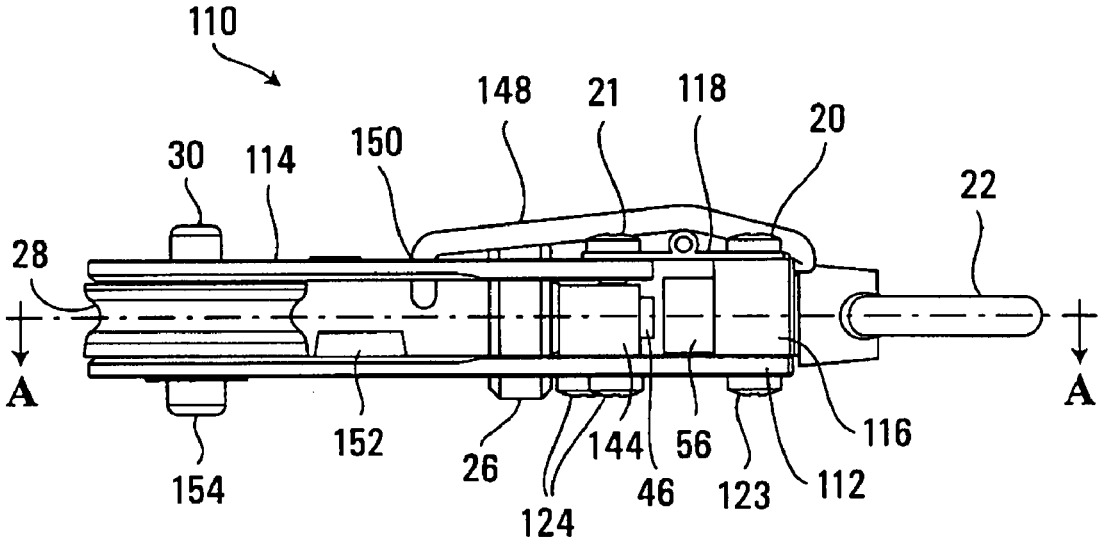
FIG. 7 is a side view of the embodiment of FIG. 6.
Figure 8:
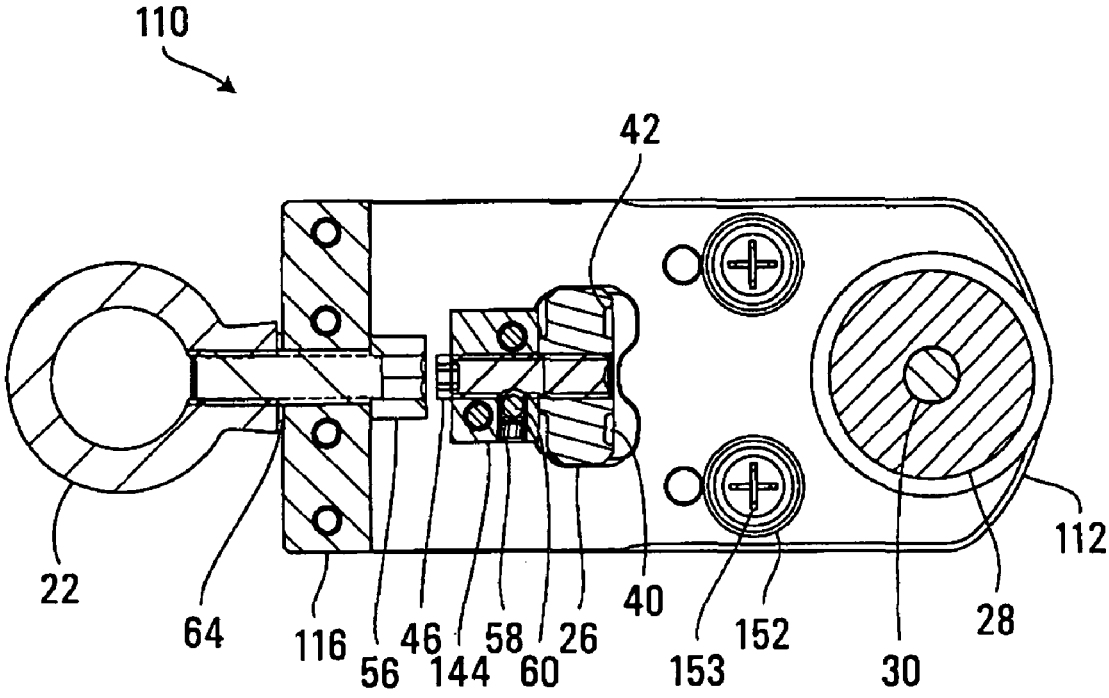
FIG. 8 is a cross-sectional view taken along lines AA of FIG. 7.

The pulley wheel 28 is mounted in the pulley 110 in the same manner as in the pulley 10. A head 154 of the pin 30, which is not visible in FIGS. 1 to 4, is shown in FIGS. 6 and 8. Further shown in FIG. 8 are a groove 165 in the pin 30 and a washer 162 which co-operate to hold the pulley wheel 28 in place. In particular, the pin 30 is inserted through a pin opening 170 from the outer side of the fixed side plate 12 until the pin head 154 rests against the outside of the fixed side plate 12. The pulley wheel is placed over the shaft of the pin 30. The washer 162 is then placed over the shaft of the pin 30 and positioned in the groove 165. The washer 162 is larger than the hole through the pulley wheel 28 and so retains the pulley wheel 28 on the shaft of the pin 30. Other means of mounting the pulley wheel may also be used. It can be seen from FIGS. 7 and 9 how the pinhead 154 rests against the outer side of the fixed side plate 112.

Rather than using a spring, the pulley 110 utilizes an elastic cord 148 to bias the pivoting side plate 114 toward an open position. The pivoting side plate 114 has two cord holes 150. The cord 148 is an elastic cord. The cord extends between and passes out of both holes 150 as a means of attaching the elastic cord 148 to the pivoting side plate 114. Other attachment means may be utilized. The ends of the elastic cord 148 are fastened to the pulley 110 by clamping the ends between the hinge 118 and the block 116. The block 116 has grooves 117 defined therein for positioning the elastic cord 148 and to ensure that the hinge 118 can be screwed flush against the block 116. When the pivoting side 114 is in a closed position, the elastic cord 118 is stretched thereby biasing the pivoting side plate 114 to an open position. The elastic cord 148 will move the pivoting side plate 114 towards an open position when the detent 30 is released in a similar manner to the spring 24 described with respect to FIGS. 1 to 4.

The lock for the pulley 110 functions in essentially the same way as the lock described with respect to pulley 10 of FIGS. 1 to 4. The lock of FIGS. 6 to 9 has two additional features. First, the fixed side plate 112 has a lock knob opening 136. The lock knob openings 36 and 136 define the limits of travel of the lock knob 26 and allow the lock knob 26 to be accessed from the outside face of both the fixed side 112 and the pivoting side plate 114.

Second, a lock mount 144, comparable to the lock mount 44, has an additional feature not shown in FIGS. 1 to 4. In particular, the lock mount 144 has a hole 145 extending through the side. A ball 60 is located therein and a screw 58 is screwed to hold the ball in place. As can be best seen in FIGS. 8 and 9, the screw 58 can be used to push the ball 60 into a recessed defined in the threaded shaft 46. A lock override is thereby activated to "lock" the lock knob 26 in a fixed position. The position for the override shown in FIG. 7 is an open position of the lock knob 26. Other means may be used to lock the lock knob in the opened or closed position by preventing rotation of the lock knob. Such other means may be internal or external to the lock. If another form of a lock is used, which does not utilize a rotatable lock knob, then another means of overriding the lock may be used. This feature essentially provides a double lock when the override is configured to fix the lock knob in the locked position.

Figure 9:
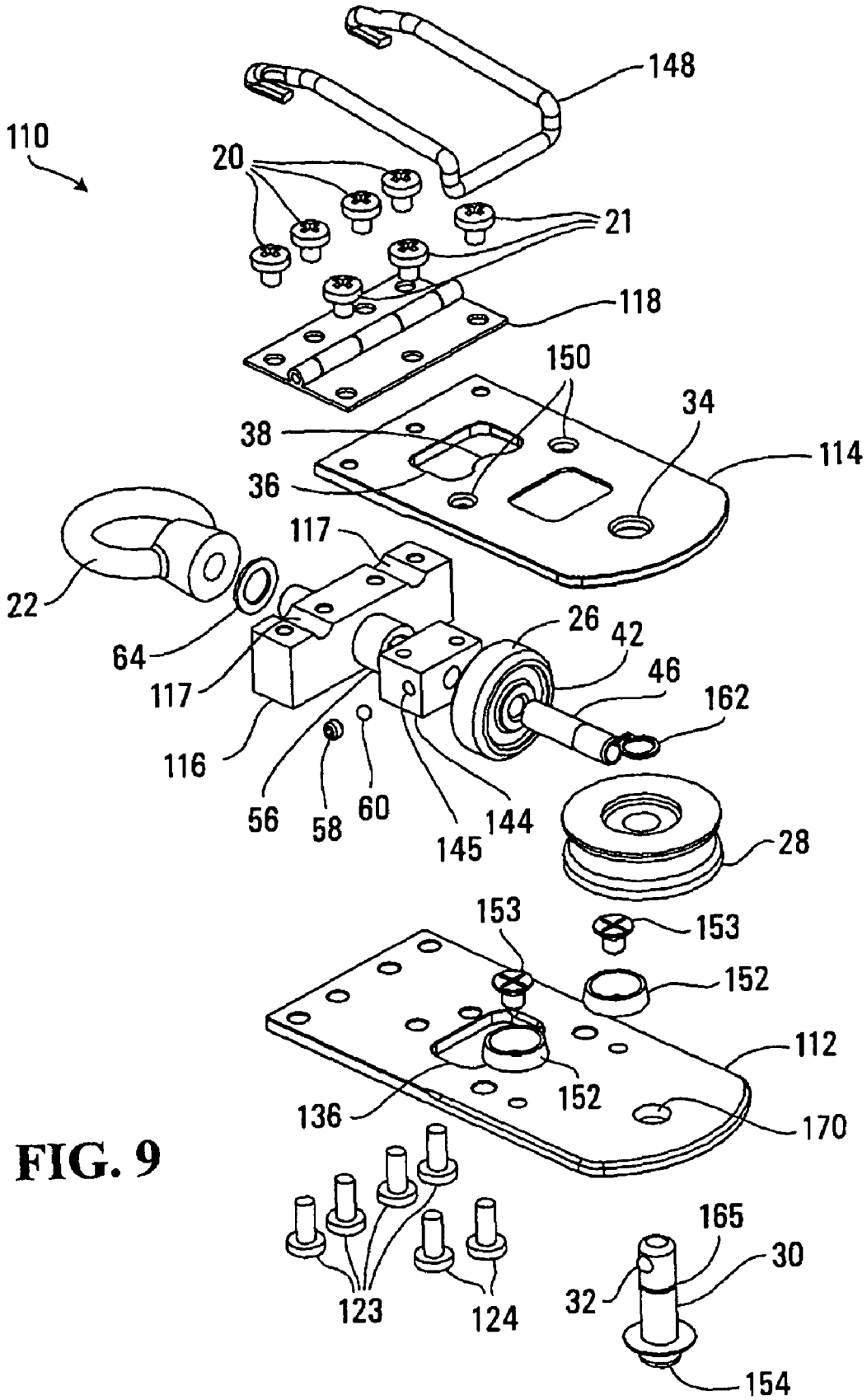
FIG. 9 is an exploded view of the embodiment of FIG. 6.

FIG. 9 also shows screws 124 which are used to fasten the lock mount 144.

The pulley 110 is of a lower profile than the pulley 10. According a smaller breaker is used on the line through the pulley 110 to open the pulley 110 to ensure that the smaller breaker stays in position to open the pulley 110 when it travels between the plates 112 and 114, two washers 152, attached by screws 153, can be provided. The washers 152 are positioned on the inner side of the fixed side plate 112 at edge of the fixed side plate 112, adjacent an inner side of the pulley wheel 28. The washers 152 and the pulley wheel 28 define a channel which helps guide the breaker in the desired path. Other means to guide the breaker may be used but a means of guiding the breaker, is not essential.

Numerous modifications and variations of the present invention are possible in light of the above teachings. It is therefore to be understood that within the scope of the appended claims, the invention may be practiced otherwise than as specifically described herein.

The invention claimed is:

1. A pulley comprising:

a pulley frame comprising two sides;

a pulley wheel between the two sides, the pulley wheel being rotatably supported by the pulley frame;

a pivoting means pivotally connecting at least one of the two sides to the pulley frame for pivoting the at least one side between a closed position for confining a line between the two sides and an open position for releasing the line from the pulley;

a latch for releasably retaining the at least one side in the closed position, the latch being adapted to release the at least one side when a predetermined force is applied to the latch; and a biasing means associated with the at least one side which biases the at least one side to the open position when the latch is released.

2. The pulley according to claim 1 wherein the biasing means is integral to the pivoting means.

3. The pulley according to claim 1 wherein the pivoting means comprises a hinge including a hinge pin and the biasing means comprises an axial torsion spring mounted on the hinge pin.

4. The pulley according to claim 1 wherein the biasing means comprises at least one elastic cord connected between the at least one side and the pulley frame wherein the at least one elastic cord is stretched in the closed position and contracted in the open position.

5. The pulley according to claim 4 wherein at least two holes are defined through the at least one side and the elastic cord is interconnected to the at least one side through the at least two holes.

6. The pulley according to claim 4 or claim 5 wherein the elastic cord is held within the frame by being clamped between elements of the frame.

7. The pulley according to claim 1 wherein the latch is self-opening upon application of the predetermined force by the line or a breaker on the line.

8. The pulley according to claim 1 further comprising:

a lock movable between a locked position and an unlocked position wherein in the locked position the at least one side is prevented from moving to the open position when the predetermined force is applied and in the unlocked position the at least one side is movable to the open position.

9. A pulley comprising a pulley frame comprising two sides;

a pulley wheel between the two sides, the pulley wheel being rotatably supported by the pulley frame;

a pivoting means pivotally connecting at least one of the two sides to the pulley frame for pivoting the at least one side between an open position and a closed position;

a latch for releasably retaining the at least one side in the closed position to confine a line between the two sides, the latch being adapted to release the at least one side when a predetermined force is applied; and a lock movable between a locked position and an unlocked position wherein in the locked position the at least one side is prevented from moving to the open position when the predetermined force is applied and in the unlocked position the at least one side is movable to the open position.

10. The pulley according to claim 9 wherein the lock is independent of the latch.

11. The pulley according to claim 9 wherein the lock is accessible from both outer sides of the pulley.

12. The pulley according to claim 9 wherein the lock comprises a movable part and a protruding element, the movable part defining a lip adapted to engage the protruding element in the locked position, the movable part and the protruding element forming part of respective ones of the frame and the at least one side.

13. The pulley according to claim 12 wherein the movable part is movable in a direction perpendicular to a rotational axis of the pulley wheel and a pivoting axis of the at least one side.

14. The pulley according to claim 12 wherein the movable part comprises a threaded knob which is rotatable to move axially between the locked position and the unlocked position.

15. The pulley according to claim 14 wherein the threaded knob projects through openings defined in the two sides.

16. The pulley according to claim 15 wherein the shape of the openings define limits of travel of the threaded knob.

17. The pulley according to claim 14 wherein the lip is defined by a groove in the knob.

18. The pulley according to claim 12 wherein the protruding element comprises a portion of one of the sides which protrudes into the opening.

19. The pulley according to claim 12 wherein the lock further comprises an override movable between an activated position and an unactivated position wherein in the activated position the lock is prevented from moving and in the unactivated position the lock is movable.

20. A pulley comprising:

a pulley frame comprising two sides;

a pulley wheel between the two sides, the pulley wheel being rotatably supported by the pulley frame;

at least one of the sides being mounted for movement away from the pulley wheel to provide a gap between the moveable side and the wheel for releasing a line from the pulley;

a latch for releasably retaining the at least one side in the closed position to confine a line between the two sides, the latch being adapted to release the moveable side when a predetermined force is applied to the latch; and a retainer responsive to the release of the latch to hold the moveable side in the open position.

21. The pulley according to claim 20 further comprising:

a lock movable between a locked position and an unlocked position wherein in the locked position the movable side is prevented from moving to the open position when the predetermined force is applied and in the unlocked position the moveable side is movable to the open position.

22. The pulley according to claim 20 wherein the retainer moves when the latch is released.

23. The pulley according to claim 20 wherein the retainer comprises at least one pair of magnets of opposite polarity.

* * * * *